United States Patent [19]

Breslau et al.

[11] 4,087,926

[45] May 9, 1978

[54] DRYING APPARATUS FOR PHOTO PRINTS AND THE LIKE

[75] Inventors: Steven M. Breslau, Cranford; Morris Gary Grossman, Wyckoff, both of N.J.; Edward D. Levy, Spring Valley, N.Y.

[73] Assignee: Falcon Safety Products, Inc., Mountainside, N.J.

[21] Appl. No.: 701,626

[22] Filed: Jul. 1, 1976

[51] Int. Cl.[2] ..... F26B 19/00

[52] U.S. Cl. ..... 34/70; 34/90; 34/150; 100/93 RP; 211/50

[58] Field of Search ..... 211/11, 42, 50, 181; 52/579, 588, 595; 403/393, 387, 363; 34/70, 71, 60, 150, 90, 95; 100/93 RP

[56] References Cited

U.S. PATENT DOCUMENTS

| | | | |
|---|---|---|---|
| 301,204 | 7/1884 | Berry | 211/50 |
| 423,647 | 3/1890 | Wells | 211/11 |
| 550,048 | 11/1895 | Ketchum | 211/181 |
| 1,085,230 | 1/1914 | Wild et al. | 34/70 |
| 1,628,554 | 5/1927 | Pagano | 100/93 RP |
| 1,739,505 | 12/1929 | Cunningham | 34/70 |
| 1,909,566 | 5/1933 | Bender et al. | 211/181 |
| 2,146,255 | 2/1939 | Gaebel | 34/70 |
| 2,469,966 | 5/1949 | Idle | 211/181 |
| 3,487,756 | 1/1970 | Glaza et al. | 52/579 |

*Primary Examiner*—John J. Camby
*Assistant Examiner*—Larry I. Schwartz
*Attorney, Agent, or Firm*—Davis, Hoxie, Faithfull & Hapgood

[57] ABSTRACT

Photo print drying apparatus has a pair of manually operated squeeze rolls which feed prints toward a drying rack which is detachably connected to the squeeze roll assembly. The rack has a series of spaced inclined parallel U-shaped wires which hold prints in spaced relation during final drying by normal circulation of air without heat. The rack is detachable and connectible in tandem with other identical racks.

6 Claims, 7 Drawing Figures

DRYING APPARATUS FOR PHOTO PRINTS AND THE LIKE

This invention relates to apparatus and a system for drying photographic prints. More particularly the invention relates to provision of an economical assembly of parts for removing surplus liquid from photographic prints and for supporting one or more prints, particularly delicate resin-coated prints, in spaced relation until they are dry.

Heretofore photographic prints often were squeezed with a single manual squeegee roller or between a pair of squeeze rolls to remove excess liquid, and then the prints were passed through a drying cabinet wherein they were subjected to a hot air blast to dry them. With the advent of resin coated papers difficulties arose when attempting to dry, quickly, the resin coated prints. They could not be subjected to air heated to the temperatures previously used. Moreover, squeegees and hair dryers were cumbersome makeshifts and the prints were endangered by the possibility of the squeegee scratching the surface of the prints.

Consequently, efforts were made to provide apparatus which used lower air temperatures and longer drying times. Such apparatus was complicated and relatively expensive to make and keep in order.

Therefore, it is an object of this invention to provide apparatus which would not require hot air for drying resin-coated photographic prints or other photo prints and apparatus which may be easily and economically fabricated from a small number of parts which may be and preferably are molded from synthetic plastic material.

Another object is to provide apparatus of the foregoing type including cooperating squeeze rolls mounted for manual operation and having a novel, simple means for capturing and disposing of the liquid squeezed from the prints.

Another object is to provide apparatus of the foregoing type having a drying rack detachably connected therewith in which the prints may be placed in spaced relation to dry. A related object is to provide a drying rack which is capable of being located in a horizontal or a vertical position with the prints positioned in different ways in one position or the other to overcome their tendency to curl as they dry. Another related object is to provide a drying rack which will be touched by a print, as it curls during drying, at only a few points at its edges.

Another object is to provide apparatus of the aforesaid type which is non-electric and will require a minimum amount of space so as to be particularly adapted for use in the very limited amount of space normally available in dark rooms.

Other objects and advantages of the invention will appear as it is described in connection with the accompanying drawings.

Figure 1:
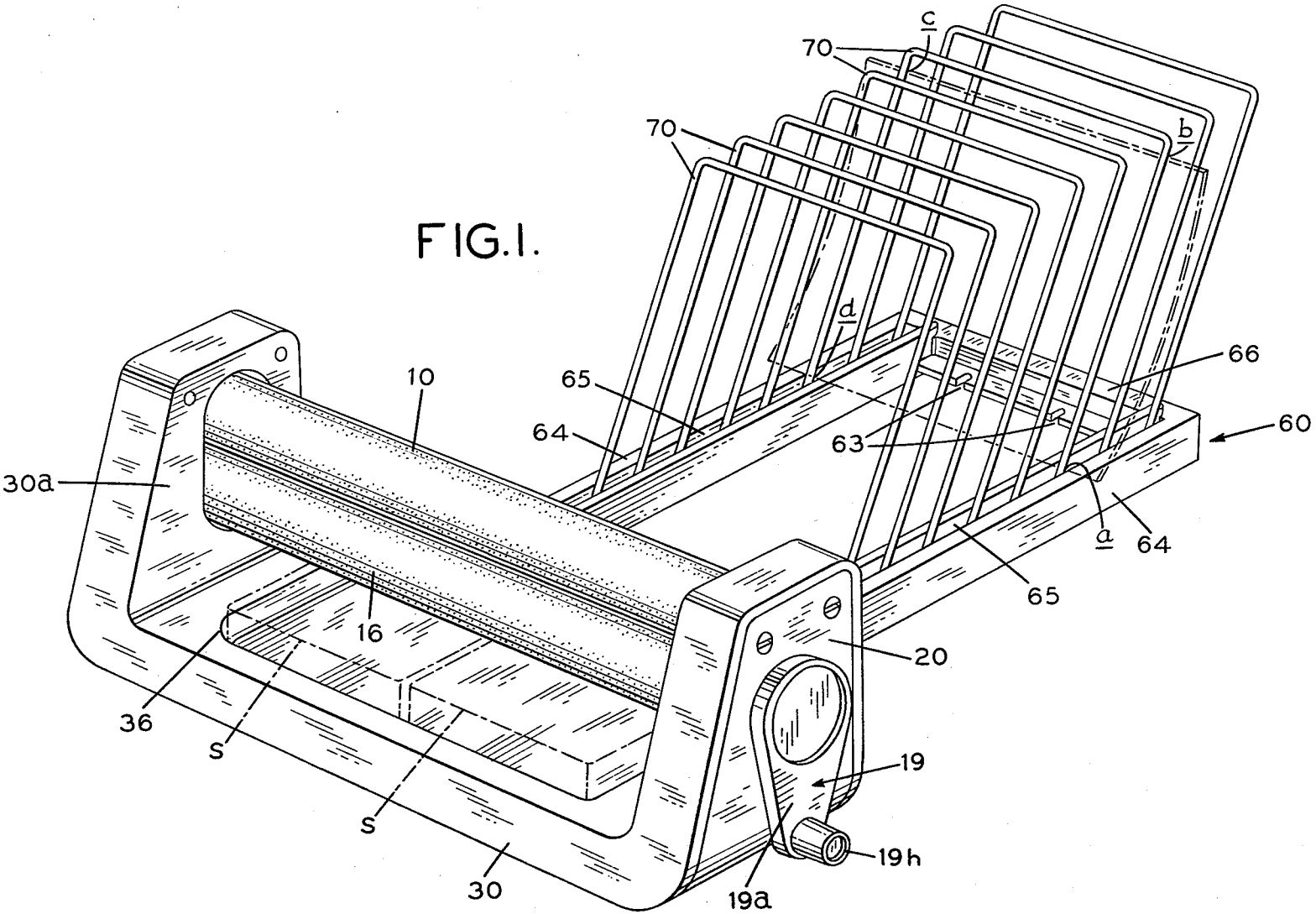
FIG. 1 is a perspective view of the invention.

Referring to the drawings, a pair of parallel manually rotatable squeeze rollers designated generally by the numerals 10 and 16 are mounted in a two-part U-shaped support composed of two mating hollow molded plastic parts 20 and 30 for rotation by a crank member 19.

The rollers 10 and 16 each have a central cylindrical core part **10*a*, 16*a* of aluminum or other tubing covered with a tight fitting smooth surfaced sleeve of non-porous resilient natural or synthetic rubber 10*c*, 16*c* or equivalent material. Inserted in each end of each roll is a hub member designated generally by the numeral 12** and preferably made of molded synthetic plastic material. The hubs are or may be identical, each having an enlarged hollow inner end 12*a* insertable into the end of the rolls. The mid-portion of the enlarged ends **12*a*** have a series of spaced parallel low ribs or ridges running parallel to the axis of the hub, to provide a firm frictional engagement with the inside of the metal core of the roll.

The opposite end **12*b* of each hub is hollow and is of reduced diameter to act as an angle. The axle part of the upper hubs rotate in bearing members designated generally by number 18. The bearing members 18 are preferably molded synthetic plastic members of T-shape. They are held in the upper ends of the parallel legs of the support part 20 by a pair of horizontally spaced parallel cylindrical bosses 32 in the upper end of the other support part 30. Arcuate recesses in the ends of the horizontal portion of the bearing members 18 embrace the bosses and are held thereby in proper vertical location, while the sidewalls of the support 20 and 30 hold the bearings from movement laterally. In the downwardly facing portion of the bearing member 18 an inverted cradle in the form of an arcuate bearing recess is provided for the outer reduced end or axle part 12*b* of the hub. The axle part is held against the bearing by upward pressure of the lower roll against the upper 12** as will be more clearly apparent hereinafter.

The outer and inner support members 20 and 30 are preferably parts molded from synthetic plastic material possessing resistance to staining and corrosion by the photographic chemicals, traces of which may remain in rinse water after washing of the prints. The members 20 and 30 are not identical but are each of generally U-shape and hollow and formed so that when they mate together at their peripheral edges a hollow support is formed. The upstanding vertical parts **20*a*, 20*b*, and 30*a*, 30*b*** house the bearing ends of the rolls and the bearing parts of the device. The horizontal parts of the support members cooperate to form a hollow base for the support.

To hold the device against sliding and in stationary position on a table or other supporting surface when the device is in use, four inverted conical, flexible rubber suction cups 23 are secured by securing screws.

To keep the horizontal surfaces of the base part separate, four posts 34 are molded in spaced positions extending downwardly from the bottom wall of the inner and upper member 30. See FIG. 5. For securing the two support parts 20 and 30 together, securing screws 35 extend through holes in the bottom wall of the bottom member 20 and thread into the posts 34.

The hub members 12′ of the bottom roll 16 are supported on bearing members 40 preferably molded from synthetic plastic material. They are located in the hollow space between the sidewalls of the vertical arms of the support parts 20 and 30. These lower bearings have an arcuate upper end providing a bearing surface for the axle parts 12*b* on the ends of the hub of the lower roll 16. The lower bearings 40 float and are resiliently supported by a vertical coiled compression springs 42 and the bottom of bearings 40 each have a spring-locating extension which projects into the upper end of the spring. The lower ends of the springs 42 seat on inward protuberances 20*s* at the bends of the lower or outer support part 20. An upward extension from each protuberance enters its spring 42 maintaining it in place. Thus, springs 42 bias lower roll against the upper. To guide the floating bearings parallel vertical flat ribs 20*r* are formed on the inner wall of vertical arms 20*a* of member 20.

Figures 2, 3, 5:
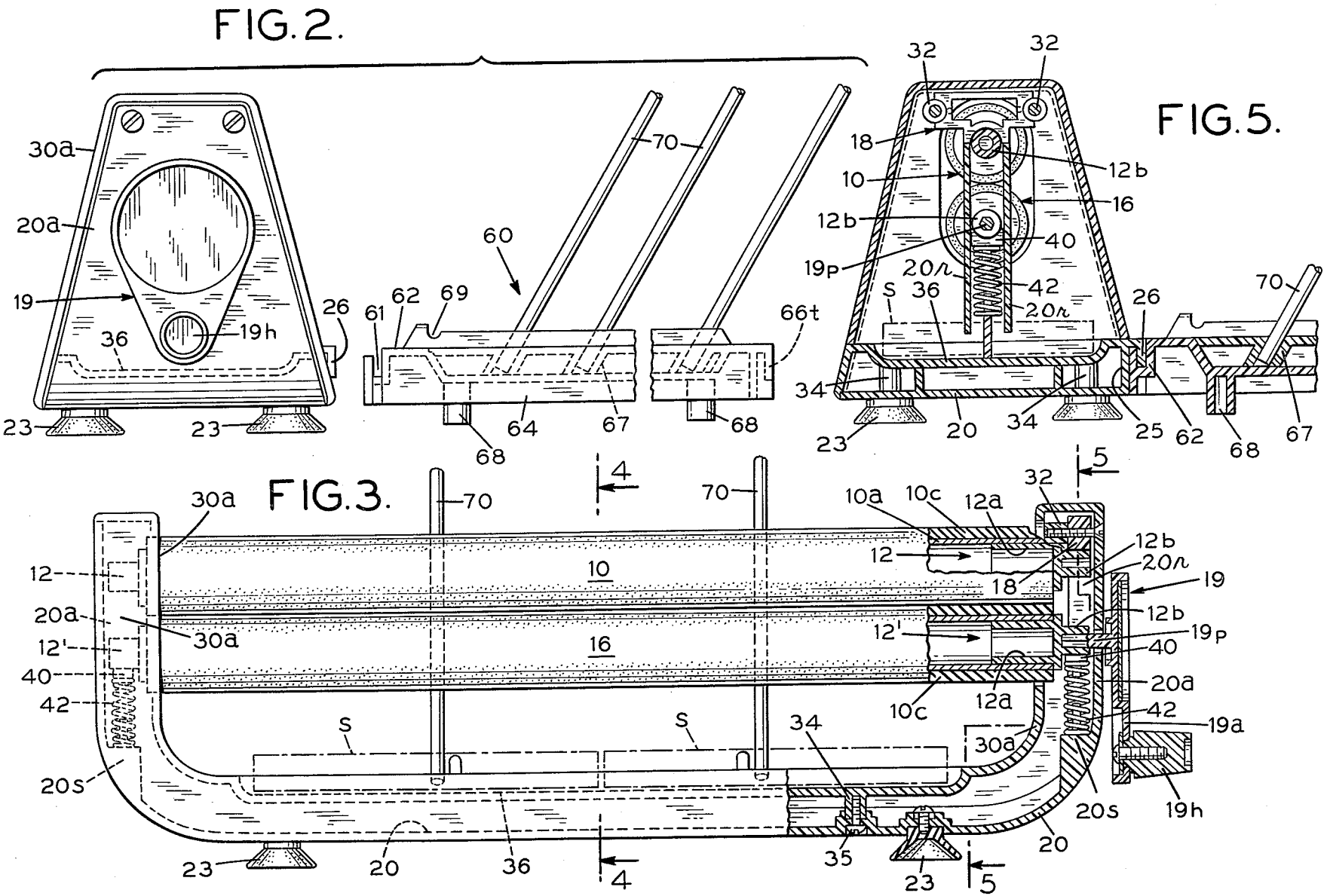
FIG. 2 is a side elevation view partly broken away illustrating the squeeze-roller assembly and the print-supporting rack separated from one another.
FIG. 3 is an end elevation view partly in section of the squeeze-roller assembly of the invention.
FIG. 5 is a section view similar to FIG. 4 but the section being taken along line 5,5 of FIG. 3.
Figure 4:
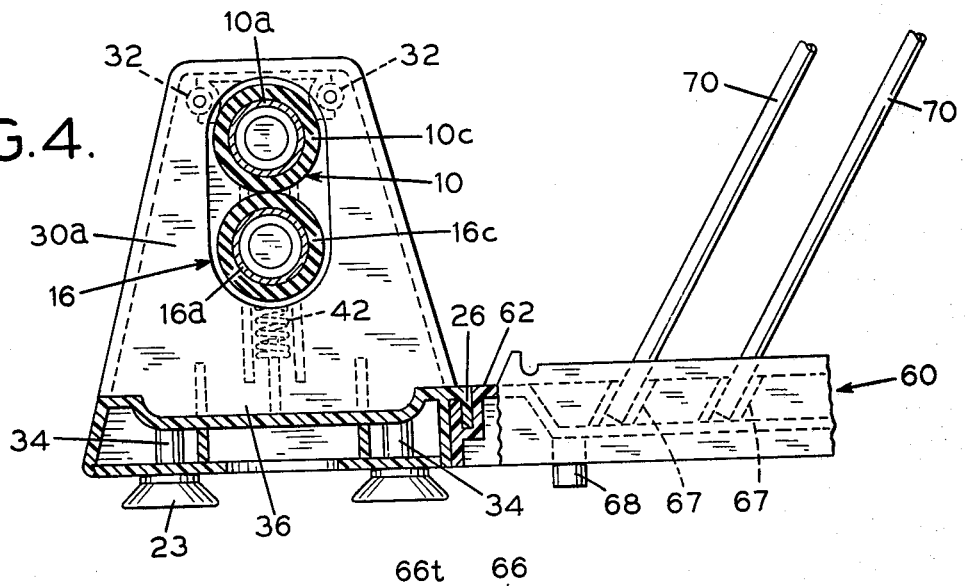
FIG. 4 is a section view partly broken away and partly in section with the section being taken generally along line 4,4 of FIG. 3.

In order to rotate the lower roll 16 the crank 19 is connected to one of the hubs 12*b*, (the right one in FIG. 3). The crank is preferably of molded synthetic plastic material having a flat crank arm part 19 with a tapered cylindrical knob or handle 19*h* extending laterally outward therefrom. Extending laterally inward from the opposite end of the arm 19*a* is a pivot pin 19*p* which is hexagonal in cross-section and slightly tapered. The axle part of the lower hub 12*b* is hollow and its interior wall is hexagonal in cross-section and slightly tapered to receive a pivot part 19*p* of the crank which may be force fitted therein.

From the foregoing, it will be apparent that by rotating the crank 19, the lower roll 16 will be rotated by its hub. Pressure of lower roll against the upper roll bias of the supporting springs 42 will cause rotation of the upper roll by the lower roll. Feeding of a wet photo print between the rolls will squeeze liquids therefrom leaving the print in almost dry condition and ready for final drying by circulation of air.

In order to catch drippings from the rolls during the squeezing operation, the upwardly facing horizontal surface of support part 30, which surface lies beneath the rolls, is hollowed to form a shallow tray or reservoir 36 preferably of rectangular shape and preferably of size to receive one or more sponges such as two common kitchen sponges. As the drippings fall, they are retained in the reservoir and absorbed by the sponges which can be removed, squeezed to expel excess liquid, rinsed and replaced periodically as needed.

The problem of handling or disposing of the almost dry prints where circulation of air will complete the drying process has not been solved in a convenient or simple fashion heretofore. Resin coated prints require careful handling so that their surfaces will not be scratched and so that they will not curl up during the drying process and so that any small residue of minute droplets of water will not drain into one point in the middle of the print as it curls during drying leaving an unsightly spot or spots upon the face of the print. Moreover, if the prints are laid flat side by side on a flat surface, there is a danger of dust falling upon them due to the large uncovered surface area.

In order to overcome this problem, an open rectangularly shaped frame or rack 60 is detachably connected to the support part 20.

The rack 60 is preferably made or molded synthetic plastic material with two parallel sides 64 connected at their ends by transverse part 62 and 66.

To detachably connect the rack to the support a downwardly directed tongue 26 is provided as an extension of the back longitudinal edge 25 of the support part 20 and running parallel to and part way along said edge. The tongue 26 is detachably received in groove 61 formed in one end 62 of the rack 60.

Each side 64 of the rack has a channel 65 running along its upper surface. In each channel at spaced points round sockets 67 are formed to receive the ends of inverted U-shaped plastic coated, preferably vinyl coated, wires 70.

The sockets are slanted at a convenient angle preferably in the neighborhood of 60° so that the wires 70 may be supported in spaced apart relationship parallel to each other in the series at an inclination of about 60°. The squeeze-dried prints can be placed individually in the rack, each print facing upwardly with its bottom edge near its corners resting against one of the wire supports, without danger of becoming scratched since the wires are coated with smooth, non-abrasive plastic material.

The rack provides means to overcome the tendency of the prints to curl up when drying. By placing the long edge of the print in position to rest on its bottom on the rack with the print facing upwardly, the front of the print will touch the wire support in front of it at only its edges at four points, *a* and *d* at the bottom edge and *b* and *c* at the top edge of the print as shown in FIG. 1 wherein a print is shown in dashed lines. The print touches the wire support in back at two, mid-points. The wire supports are preferably close enough to prevent any but a minor bend during drying.

If it is desired in unusual conditions to utilize the wire nearest the rolls aligned notches 69 may be formed in the rack 60 to receive the bottom edge of a print which will then lie with its back face resting on the first supporting wire of the series. However, this is not entirely satisfactory because of lack of both front and back support of the prints.

Figure 6:
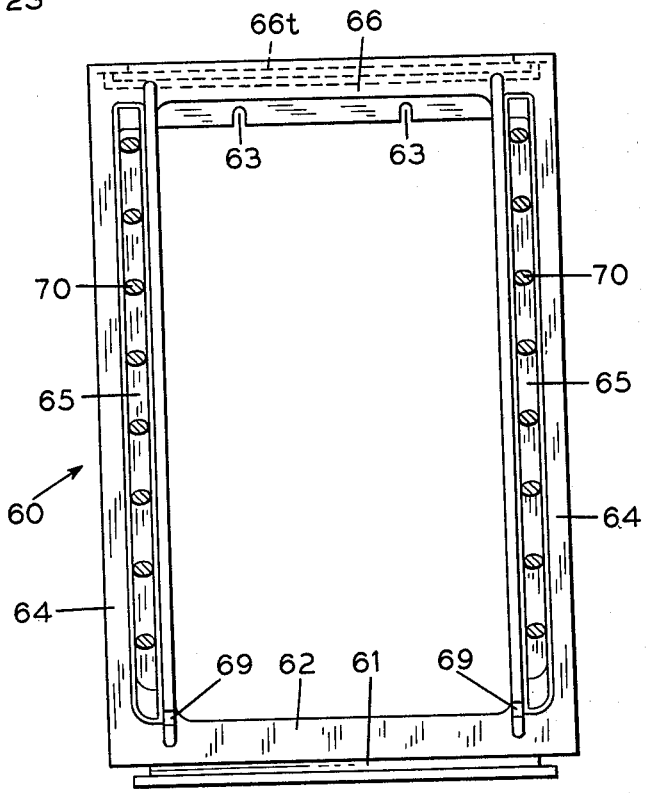
FIG. 6 is a plan view of the drying rack with the ends of the print-supporting wires in section.
Figure 7:
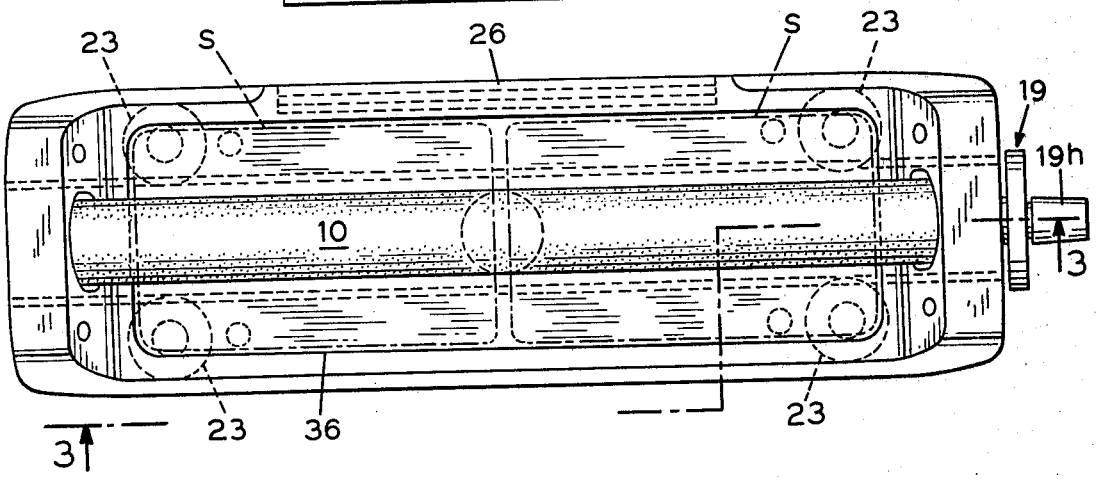
FIG. 7 is a plan view of the squeeze-roller assembly of the invention.

The ends of the supporting wires are shown in cross-section of FIG. 6 seated in their sockets.

Instead of U-shaped supports, pairs of straight parallel wires (not connected at their tops as in the U-shaped form) can be used to give the same front and back support to the prints at the same points above mentioned.

In order to facilitate air circulation about and around the prints, the rack preferably is supported above the surface on which it rests by the provision of four short cylindrical feet 68 which are molded as part of the sides 64 and extend downwardly. This enables air to circulate under the frame of the rack and up through its open center.

The rack 60 may be detached from the squeeze roller assembly by lifting the tongue 26 from the groove 61 of the rack. The rack is shown separated in FIG. 2. The rack may then be hung upon a wall or other vertical surface.

The ability to separate the rack from the squeeze-roller assembly not only enables the rack to be used in either a horizontal or a vertical position but also enables duplicate racks, which are interchangeable, to be used, whereby a large number of prints may be dried simultaneously in the relatively small space that is available in dark rooms.

When hung upon a wall, the placement of the prints in the rack against the supporting wires will be the reverse of the placement when the rack is in a horizontal position. In other words, the coated or picture face of the print will face upwardly with the back of the print resting upon the wire beneath it.

In order to facilitate the hanging up of the rack in the vertical position, two recesses or notches may be provided in the interior peripheral surface of the transverse part 66 in space position to receive screws or nails or the like.

It is sometimes desirable to connect one or more racks in tandem either horizontally or vertically. For that purpose the end 66 of the rack may be formed with a tongue *66t* extending downwardly from it like the tongue 26, to be received in the groove 61 of the second rack.

From the foregoing it will be apparent that the invention provides an assembly of parts which are of simple structure and may be easily manufactured and assembled to provide for removing liquid from and for drying resin-coated or other photographic prints or their equivalents. Moreover, the assembly avoids the need for any forced air drying mechanism and complicated and expensive enclosures. Thus the apparatus may be made at low cost within the reach of all persons interested in photographic development.

Many modifications within the scope of the invention will occur to those skilled in the art. Therefore, the invention is not limited to the precise form and configuration of the parts as illustrated and described.

We claim:

1. A portable table top photo print drying apparatus comprising the combination of integrated disconnectable units, one unit being a squeeze unit and another being a rack unit, said squeeze unit comprising portable U-shaped supporting means molded from synthetic plastic material, said supporting means having a transverse portion adapted to be supported on a tabular surface and also having recessed portions upstanding from each end of said transverse portion, a pair of squeeze rolls parallel to said transverse portion, bearing means for said rolls mounted in said recessed portion of said U-shaped supporting means, crank means extending from one of said end portions of rotating said rolls, said rack means comprising a rectangular base member molded from synthetic plastic material extending in substantially coplanar relation to the transverse portion of said squeeze unit and adapted to be supported on said horizontal tabular surface, spaced wire-like members extending up from said base member in parallel relationship for supporting prints issued from said squeeze rolls, and quick disconnectable means molded integrally with said units connecting one edge of said rack unit to one edge of said squeeze unit.

2. Apparatus as claimed in claim 1 wherein the connecting means comprise tongue means and groove means one being on said base member and the other on said roll supporting means.

3. Apparatus as claimed in claim 2 wherein the rack means has tongue means at one end and groove means at its opposite end, the tongue and groove connection between said rack means and said roll-supporting means being disconnectible, and a second rack like the aforesaid rack means, the tongue means on one rack means being connectible to groove means on the other rack for connecting two rack means in tandem.

4. Apparatus as claimed in claim 1 wherein the bearing means supporting one roll is fixed and the bearing means supporting the other roll floats, biasing means engaging said floating bearing means and urging said other roll against said one roll, and guide means on said U-shaped supporting means guiding the movement of said floating bearing means.

5. Apparatus as claimed in claim 1 wherein said rolls are hollow, hub means in the ends of each roll, the bearing means being fixed and engaged with the hub means of one roll, the bearing means of the other roll being floating and engaged with the hub means of said other roll, biasing means engaging said floating bearing means and urging said other roll against said one roll.

6. Apparatus as claimed in claim 1 wherein a reservoir is molded in said supporting means beneath said rolls to receive liquid squeezed from prints.

* * * * *